US008720882B2

(12) United States Patent
Fuda et al.

(10) Patent No.: US 8,720,882 B2
(45) Date of Patent: May 13, 2014

(54) SHEET FEEDING DEVICE AND IMAGE FORMING APPARATUS

(71) Applicants: Munehisa Fuda, Miyagi (JP); Hideyuki Satoh, Miyagi (JP); Taewon Kim, Miyagi (JP); Toshihiro Okutsu, Miyagi (JP)

(72) Inventors: Munehisa Fuda, Miyagi (JP); Hideyuki Satoh, Miyagi (JP); Taewon Kim, Miyagi (JP); Toshihiro Okutsu, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/644,915

(22) Filed: Oct. 4, 2012

(65) Prior Publication Data

US 2013/0087967 A1 Apr. 11, 2013

(30) Foreign Application Priority Data

Oct. 6, 2011 (JP) ..... 2011-221844

(51) Int. Cl.
*B65H 3/14* (2006.01)

(52) U.S. Cl.
USPC ..... 271/97; 271/171

(58) Field of Classification Search
USPC ..... 271/171, 97
See application file for complete search history.

(56) References Cited

U.S. PATENT DOCUMENTS

| | | | | |
|---|---|---|---|---|
| 5,092,578 | A * | 3/1992 | Bergmeier et al. | 271/97 |
| 5,110,110 | A * | 5/1992 | Wirz et al. | 271/98 |
| 7,708,264 | B2 * | 5/2010 | Kosugi et al. | 271/97 |
| 7,934,720 | B2 * | 5/2011 | Shelhart | 271/97 |
| 8,186,668 | B2 * | 5/2012 | Wardak et al. | 271/97 |
| 8,419,009 | B2 * | 4/2013 | Yoshii | 271/97 |
| 2004/0178557 | A1 * | 9/2004 | Okazaki et al. | 271/97 |
| 2007/0194514 | A1 | 8/2007 | Ikeda | |
| 2008/0297580 | A1 | 12/2008 | Fukumoto et al. | |
| 2010/0148430 | A1 | 6/2010 | Fuda | |
| 2010/0194032 | A1 * | 8/2010 | Shelhart | 271/97 |
| 2011/0148027 | A1 | 6/2011 | Fuda | |
| 2011/0221119 | A1 | 9/2011 | Fuda | |
| 2012/0133092 | A1 | 5/2012 | Fuda et al. | |

FOREIGN PATENT DOCUMENTS

| | | |
|---|---|---|
| JP | 02-144338 | 6/1990 |
| JP | 10-194491 | 7/1998 |
| JP | 2001-354331 | 12/2001 |
| JP | 2005-096893 | 4/2005 |
| JP | 2006-327716 | 12/2006 |
| JP | 2007-145582 | 6/2007 |
| JP | 2009-057203 | 3/2009 |
| JP | 2009-96604 | 5/2009 |
| JP | 4677354 | 2/2011 |

* cited by examiner

*Primary Examiner* — Kaitlin Joerger
(74) *Attorney, Agent, or Firm* — Harness, Dickey & Pierce, P.L.C.

(57) ABSTRACT

A sheet feeding device includes a stacking unit configured to allow sheets to be stacked thereon; side end regulating members configured to make contact with both side ends of the stacked sheets so that positions of the side ends are regulated; a feeding unit configured to feed one sheet at a time from the stacked sheets; an air supply unit; and an air blow unit including a blow port from which air supplied from the air supply unit is blown against a side end of the stacked sheets, the air blow unit being housed in each of the side end regulating members. Each side end regulating member has an opening for exhausting the air that is blown from the blow port unit to the stacked sheets. An orientation of the blow port is adjustable about an axial line perpendicular to a plane corresponding to a surface of the stacked sheets.

15 Claims, 8 Drawing Sheets

SHEET FEEDING DEVICE AND IMAGE FORMING APPARATUS

CROSS-REFERENCE TO RELATED APPLICATION

The present application claims priority to and incorporates by reference the entire contents of Japanese Patent Application No. 2011-221844 filed in Japan on Oct. 6, 2011.

BACKGROUND OF THE INVENTION

1. Field of the Invention

The present invention relates to a sheet feeding device and an image forming apparatus.

2. Description of the Related Art

Various types of image forming apparatuses, such as a copier, a printer, a facsimile machine, and a multifunction peripheral that combines a copier, a printer and/or a facsimile machine, include a paper feeding device that takes out one paper sheet at a time from paper sheets stored in a paper sheet storage unit and feeds the paper sheet to an image forming unit.

Used in such various types of image forming apparatuses are various types of paper sheets other than plain paper, for example, coated paper, art paper, and film paper.

However, because such various types of paper sheets other than plain paper have a smooth sheet surface, have low air permeability, and are hygroscopic, such paper sheets tend to tightly adhere to each other. For this reason, these types of paper sheets have a problem in that, compared to plain paper sheets, they are not easily separated from each other and thus multiple paper sheets tend to be fed collectively and paper sheets tend not to be properly fed.

There are paper feeding devices that solve the above-described problem. In such paper feeding devices, side fences that regulate the side end positions of paper sheets are provided with side air nozzles and, by blowing the air supplied from an air supply unit, such as a blower, arranged in the side fences against the side end surfaces of stacked paper sheets, the paper sheets can be separated as they are fed (see Japanese Patent No. 4095656, Japanese Laid-open Patent Publication No. 2005-096893, Japanese Laid-open Patent Publication No. 2007-223700, and Japanese Laid-open Patent Publication No. 2006-327716).

There is another paper feeding device in which the side fences are not provided with air nozzles but the direction in which air is blown can be changed by rotating air nozzles and fans together (see Japanese Laid-open Patent Publication No. H02-144338). In this case, the air can be blown against the side end surfaces of the paper sheets at a desired angle.

However, the configuration for rotating the air nozzles and the fans together makes it difficult to house the air nozzles in the side fences because space allowing for the rotation is necessary, which increases the size of the device. Furthermore, there is also a problem in that the rotation mechanism for rotating the fans becomes complicated.

Therefore, there is a need for a sheet feeding device and an image forming apparatus, capable of changing the direction in which air is blown against paper sheets using a simple and compact configuration.

SUMMARY OF THE INVENTION

It is an object of the present invention to at least partially solve the problems in the conventional technology.

According to an embodiment, there is provided a sheet feeding device that includes a stacking unit configured to allow multiple sheets to be stacked thereon; a pair of side end regulating members configured to make contact with both side ends of the sheets stacked on the stacking unit so that positions of the side ends are regulated; a feeding unit configured to feed one sheet at a time from the stacked sheets; an air supply unit; and an air blow unit including a blow port from which air supplied from the air supply unit is blown against a side end of the stacked sheets, the air blow unit being housed in each of the side end regulating members. Each of the side end regulating members has an opening for exhausting the air that is blown from the blow port of the air blow unit to the stacked sheets. An orientation of the blow port of the air blow unit is adjustable about an axial line perpendicular to a plane corresponding to a surface of the stacked sheets.

According to another embodiment, there is provided an image forming apparatus that includes the sheet feeding device according to the above embodiment.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of the present invention will be described below with reference to the accompanying drawings. Regarding the drawings illustrating the embodiments, descriptions of elements, such as members and components, having the same function or shape are omitted by denoting them with the same reference numbers after they have been described once as long as they can be identified.

Figure 1:
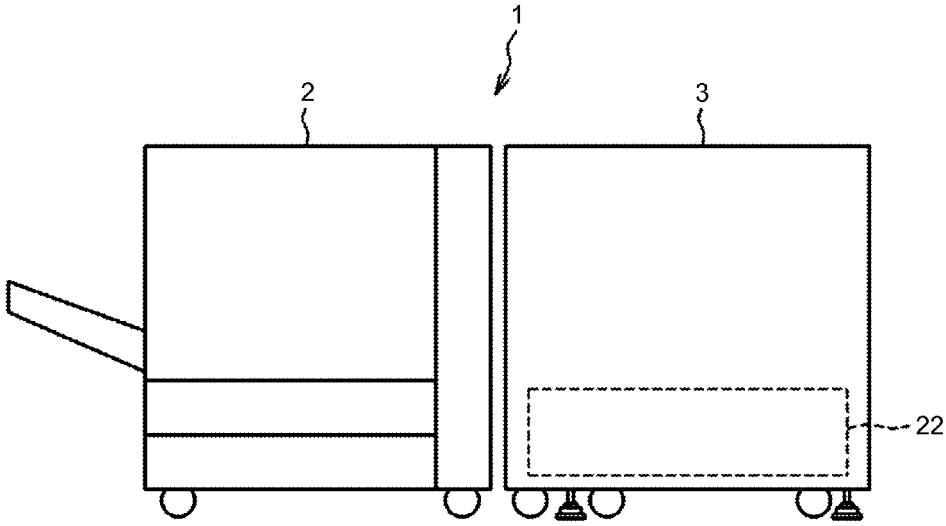
FIG. 1 illustrates a configuration of an image forming apparatus according to an embodiment of the present invention.

As shown in FIG. 1, an image forming apparatus 1 according to the embodiment includes an image forming apparatus main unit 2 and a paper feeding device 3 that functions as a sheet feeding device and that is connected to one side surface of the image forming apparatus main unit 2.

Figure 2:
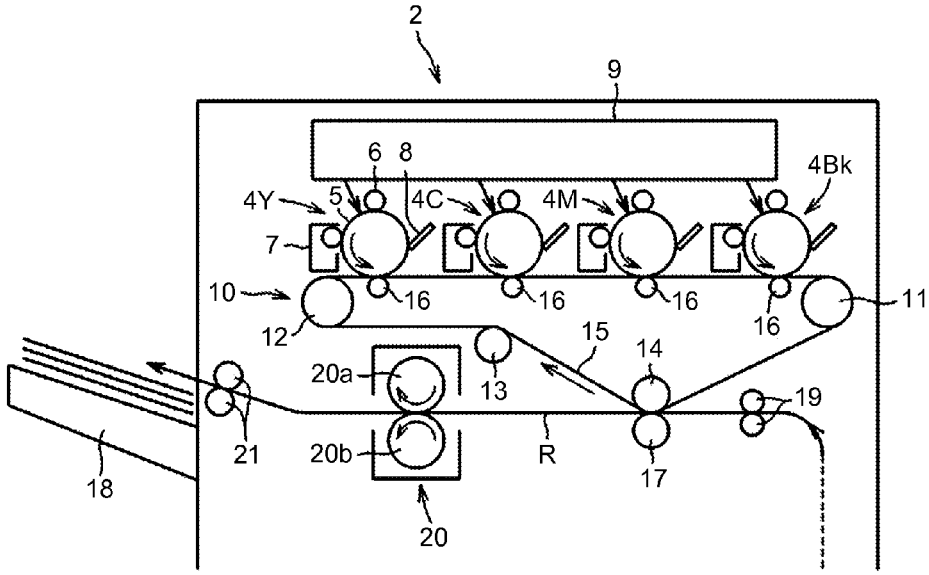
FIG. 2 is a schematic configuration diagram of a main unit of the image forming apparatus.

FIG. 2 is a schematic configuration diagram of the image forming apparatus main unit.

As shown in FIG. 2, the image forming apparatus main unit 2 includes four process units 4Y, 4C, 4M, and 4Bk. Each of the process units 4Y, 4C, 4M, and 4Bk is configured so as to be attachable to the image forming apparatus main unit 2. Each of the process units 4Y, 4C, 4M, and 4Bk has the same configuration except that they respectively store toners of yellow, cyan, magenta, and black corresponding to the color separation components of a color image.

Specifically, each of the process units 4Y, 4C, 4M, and 4Bk includes a drum-shaped photosensitive element 5 that functions as an electrostatic latent image carrier; a charging roller 6 that functions as a charging unit and that charges the surface of the photosensitive element 5; a developing device 7 that functions as a developing unit and that forms a toner image on the photosensitive element 5; and a cleaning blade 8 that functions as a cleaning unit and that cleans the surface of the photosensitive element 5. In FIG. 2, only the photosensitive element 5, the charging roller 6, the developing device 7, and the cleaning blade 8 of the process unit 4Y for yellow are denoted by reference numbers and reference numerals for components of other process units 4C, 4M, and 4Bk are omitted.

In FIG. 2, an exposing device 9 that functions as an exposing unit is arranged above the process units 4Y, 4C, 4M, and 4Bk. The exposing device 9 is configured to irradiate the photosensitive element 5 of each of the process units 4Y, 4C, 4M, and 4Bk with laser light. Under the process units 4Y, 4C, 4M, and 4Bk, a transfer device 10 is arranged. The transfer device 10 includes an intermediate transfer belt 15 that is formed as an endless belt and that is wound around rollers 11 to 14. The intermediate transfer belt 15 is configured such that, when one of the rollers 11 to 14 rotates as a drive roller, the intermediate transfer belt 15 runs and rotates in the direction denoted by the arrow shown in FIG. 2.

Four primary-transfer rollers 16 that function as primary-transfer units are arranged in positions opposed to the four photosensitive elements 5. Each of the primary-transfer rollers 16 presses against the inner surface of the intermediate transfer belt 15 in its position and a primary nip is formed in a part where the pressed part of the intermediate transfer belt 15 and each photosensitive element 5 make contact. In a position opposed to the roller 14 around which the intermediate transfer belt 15 is wound, a secondary-transfer roller 17 that functions as a secondary-transfer unit is arranged. The secondary-transfer roller 17 presses against the outer surface of the intermediate transfer belt 15 and thus a secondary-transfer nip is formed in a part where the secondary-transfer roller 17 and the intermediate transfer belt 15 make contact.

In the image forming apparatus main unit 2, a transfer route R is arranged for guiding a paper sheet supplied from the paper feeding device 3 via the secondary transfer nip to a discharge tray 18 outside the image forming apparatus main unit 2. On the transfer route R, a pair of registration rollers 19 that functions as a conveying unit and that conveys the paper sheet to the secondary-transfer nip is arranged on the upstream side with respect to the secondary-transfer roller 17 in the direction in which the paper sheet is conveyed. On the downstream side with respect to the secondary transfer nip in the direction in which the paper sheet is conveyed, a fixing device 20 that fixes a toner image on the paper sheet is arranged. The fixing device 20 includes a heating roller 20*a* that includes a heat source and a pressing roller 20*b* that presses the heating roller 20*a*. The heating roller 20*a* and the pressing roller 20*b* are pressed against each other and thus a fixing nip is formed at the place where the heating roller 20*a* and the pressing roller 20*b* are pressed against each other. A pair of discharging rollers 21 is arranged on the downstream side with respect to the fixing device 20 in the direction in which the paper sheet is conveyed.

Basic operations of the image forming apparatus will be described with reference to FIG. 2.

Each of the photosensitive elements 5 of the process units 4Y, 4C, 4M, and 4Bk is rotated anticlockwise in FIG. 2 and the surface of each of the photosensitive elements 5 is uniformly charged to a certain polarity. On the basis of image information on a document that is read by a reading device (not shown), the surface of each of the charged photosensitive elements 5 is irradiated with laser light from the exposing device 9 so that a latent image is formed on the surface of each of the photosensitive elements 5. Image information given by exposing each of the photosensitive elements 5 is single-color image information obtained by separating a desired full-color image into color information on yellow, cyan, magenta, and black. The developing devices 7 supply toner to the latent images that are formed on the photosensitive elements 5 and thus the latent images are visualized as toner images.

One of the rollers around which the intermediate transfer belt 15 is wound is rotated to cause the intermediate transfer belt 15 to run and rotate in the direction denoted by the arrow in FIG. 2. A voltage having a polarity opposite to the polarity to which the toner is charged is applied under constant voltage control or constant current control to each primary-transfer roller 16 and accordingly a transfer electric field is formed in the primary-transfer nip between each primary-transfer roller 16 and each photosensitive element 5. The transfer electric fields that are formed in the primary-transfer nips causes the toner images of the respective colors that are formed on the photosensitive elements 5 to be sequentially superposed and transferred on the intermediate transfer belt 15. Accordingly, the intermediate transfer belt 15 carries a full-color toner image on its surface. The residual toner on the surface of the photosensitive elements 5 after the transfer is removed by the cleaning blade 8.

The paper feeding device 3 shown in FIG. 1 feeds a paper sheet to the image forming apparatus main unit 2. The paper sheet that is fed to the image forming apparatus main unit 2 is conveyed to the secondary transfer nip between the secondary-transfer roller 17 and the intermediate transfer belt 15 at the timing controlled by the registration rollers 19. A transfer voltage having opposite polarity to the polarity to which the toner of the toner image on the intermediate transfer belt 15 is charged is applied to the secondary-transfer roller 17 and accordingly a transfer electric field is formed in the secondary-transfer nip. The transfer electric field that is formed in the secondary transfer nip causes the whole toner image to be transferred onto the paper sheet.

The paper sheet onto which the toner image is transferred is then conveyed to the fixing device 20 and heated and pressed between the heating roller 20*a* and the pressing roller 20*b* so that the toner image is fixed onto the paper sheet. The paper sheet is then discharged by the discharging rollers 21 to the outside of the image forming apparatus main unit 2 and stacked on the discharge tray 18.

The image forming operation for forming a full-color image on a paper sheet is described above. Any one of the four process units 4Y, 4C, 4M, and 4Bk may be used to form a single-color image or two or three process units may be used to form an image of two or three colors.

The configuration of the paper feeding device 3 will be described here.

As shown in FIG. 1, the paper feeding device 3 includes a paper feed tray 22 that can store paper sheets and that is retractable with respect to the main unit of the paper feeding device 3. The paper sheets that are stored in the paper feed tray 22 include not only plain paper but also thick paper, postcards, envelopes, thin paper, coated paper (e.g., art paper), and tracing paper. Image recording sheets, such as OHP sheets, may be stored in the paper feed tray 22.

Figure 3:
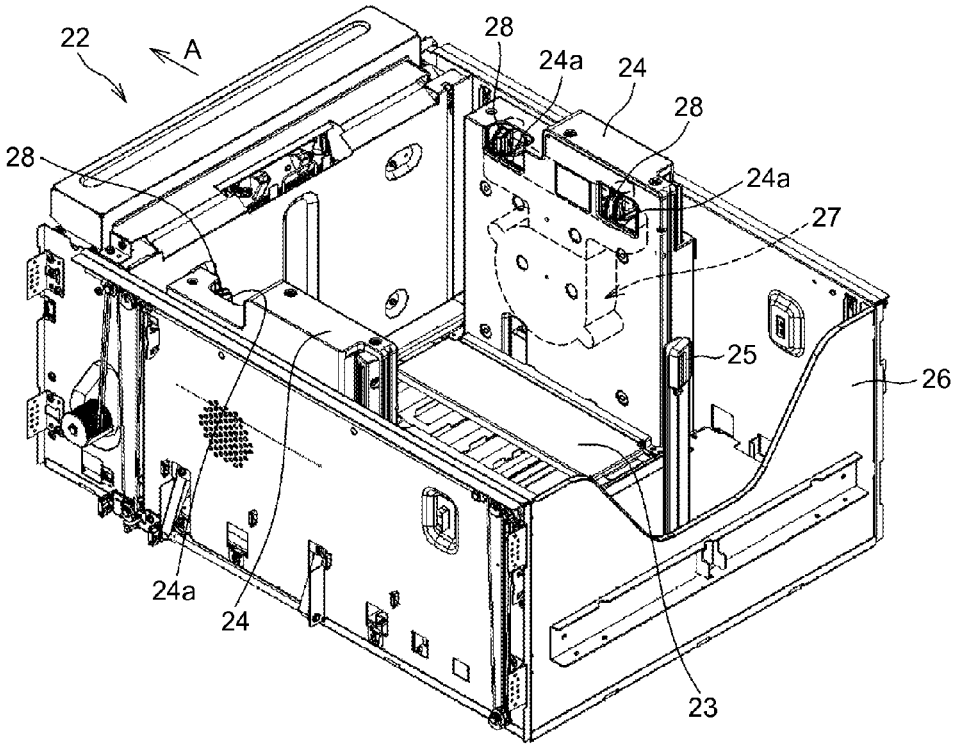
FIG. 3 is a perspective view of a paper feed tray.

FIG. 3 is a perspective view of the paper feed tray 22.

As shown in FIG. 3, the paper feed tray 22 includes a housing 26 having an open top; a bottom plate 23 that functions as a stacking unit and that is arranged horizontally at the bottom of the housing 26 and on which paper sheets that are image recording sheets can be stacked; side fences 24 that function as a pair of side end regulating members, that are arranged vertically in the housing 26, and that make contact with both side ends of the paper sheets stacked on the bottom plate 23 so that the positions of the side ends are regulated; and an end fence 25 that functions as a back end regulating unit, that is arranged vertically in the housing 26, and that makes contact with the back end of the stacked paper sheets in the direction in which the stacked paper sheet is fed so that the position of the back end is regulated. The side fences 24 are configured to be movable in the direction of the width of paper sheets for various widths of paper sheets. The end fence 25 is configured to be movable in the direction of the length of paper sheets for various lengths of paper sheets.

A blowing unit 27 is housed in each of the side fences 24. Two openings 24*a* for exhausting the air that is blown by the blowing units 27 are provided in each of opposing parts in upper parts of the side fences 24. The air is blown by the blowing unit 27 from the openings 24*a* and accordingly the air is blown against the upper region of the paper sheets.

When a paper sheet is fed from the paper feed tray 22, the air exhausted from the openings 24*a* is blown against the upper region of the paper sheets and accordingly the air is sent to the stacked paper sheets so that the adherence between the paper sheets is lowered and thus they are easily separated. In the embodiment, because the air is blown against the paper sheets in multiple directions, paper sheets can be separated sufficiently even if large-sized paper sheets are used.

In a state where the sheets are separated easily, a feeding unit (not shown) with which the paper feed tray 22 is provided starts operating so that the top paper sheet of the paper sheets is fed in the direction denoted by the arrow A in FIG. 3. A known feeding unit, such as a feed-roller reverse-roller (FRR) mechanism known as a backward separation system using a roller or an air pick-up mechanism for vacuuming and conveying a paper sheet by using a vacuum belt, may be used.

Figure 4:
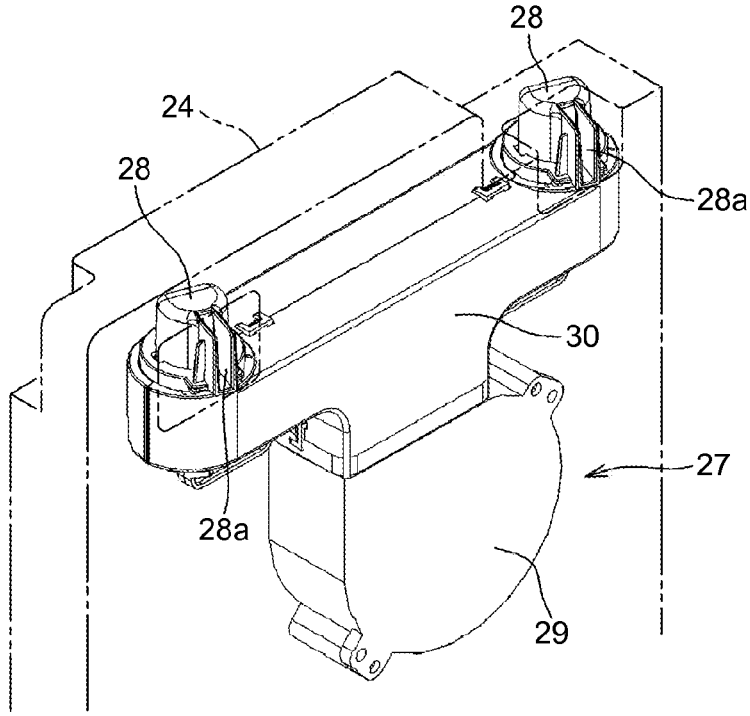
FIG. 4 is a perspective view of a blowing unit viewed from the inner side of a side fence.
Figure 5:
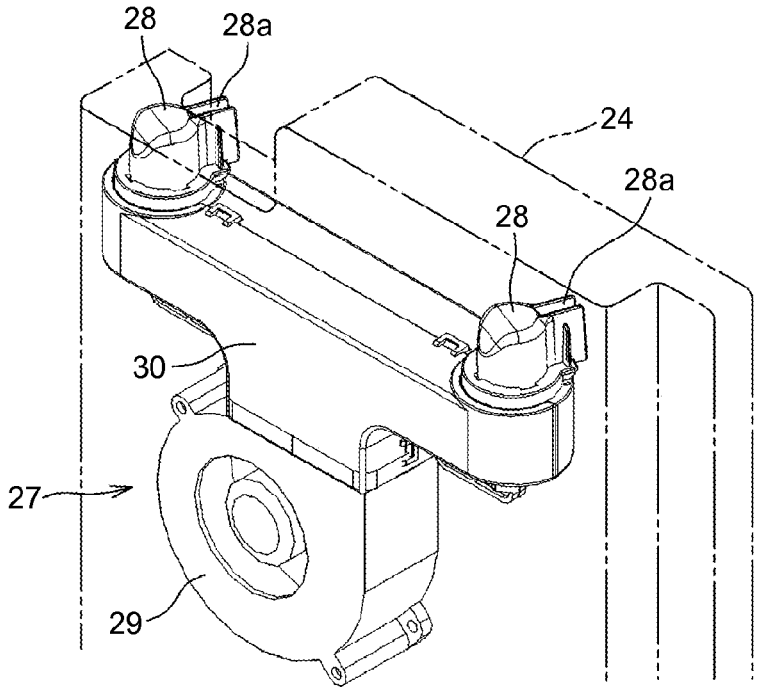
FIG. 5 is a perspective view of the blowing unit viewed from the outer side of the side fence.

FIGS. 4 and 5 depicts the configuration of the blowing unit 27 that is housed in the side fence 24.

FIG. 4 depicts the configuration viewed from the inner side of the side fence and FIG. 5 depicts the configuration viewed from the outer side of the side fence.

As depicted in FIG. 4 or FIG. 5, the blowing unit 27 includes a pair of air blow units 28 each including a blow port (nozzle) 28*a* from which air is blown; an air supply unit 29, such as a fan or a blower; and a duct 30 that forms an air flow channel for guiding the air supplied from the air supply unit 29 to each of the air blow units 28. The air blow units 28, the air supply unit 29, and the duct 30 are all housed in the side fence 24. FIGS. 4 and 5 illustrate only the blowing unit 27 that is housed in one of the side fences 24, but the blowing unit 27 that is housed in the other side fence 24 has the same configuration.

Figure 6:
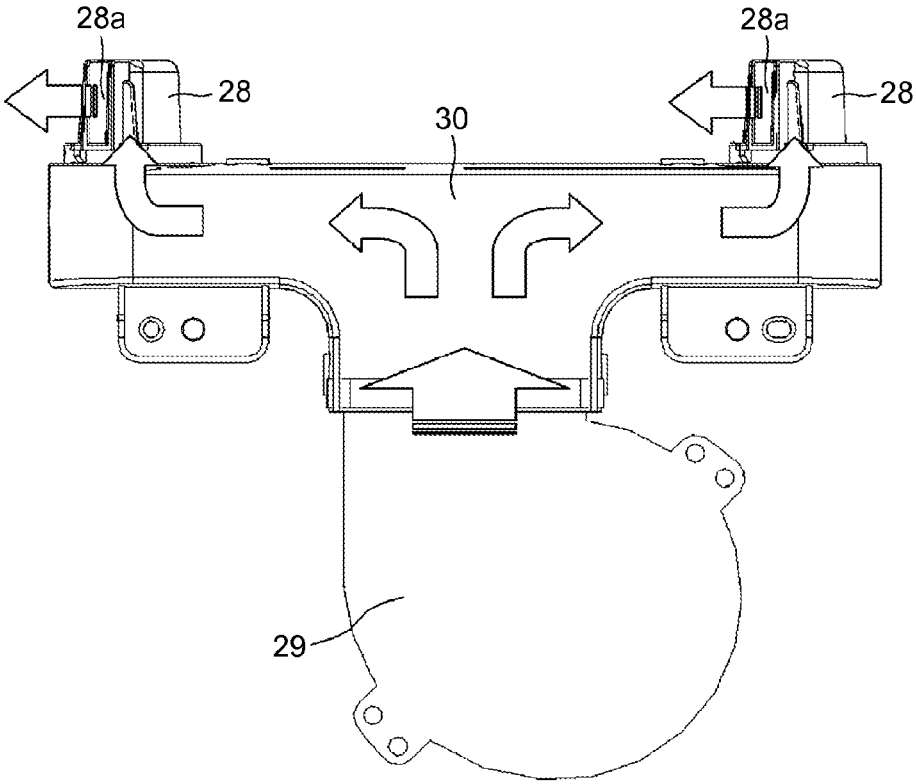
FIG. 6 illustrates the flow of air from the blowing unit.

FIG. 6 is a diagram depicting the flow of the air from the blowing unit.

As the arrow in FIG. 6 denotes, the air supplied from the air supply unit 29 diverges to the right and left in the T-shaped duct 30 and blows from the blow ports 28*a* of the respective air blow units 28 that are provided on upper parts of the duct 30 on both sides. Specifically, the air supplied upward from the air supply unit 29 diverges horizontally at a center part of the duct 30 and the diverged air is sent upward into the air blow units 28 at both ends. The direction of the air is then changed horizontally in each of the air blow units 28 and the air blows from the blow ports 28*a*.

As described above, in the embodiment, by using the duct 30 that bifurcate, the air supplied from the single air supply unit 29 is blown as air in multiple (two in the above-described embodiments) volumes. Such a configuration does not require a dedicated air supply unit 29 for each air blow unit 28, which reduces the costs, power consumption, and size.

Figure 7:
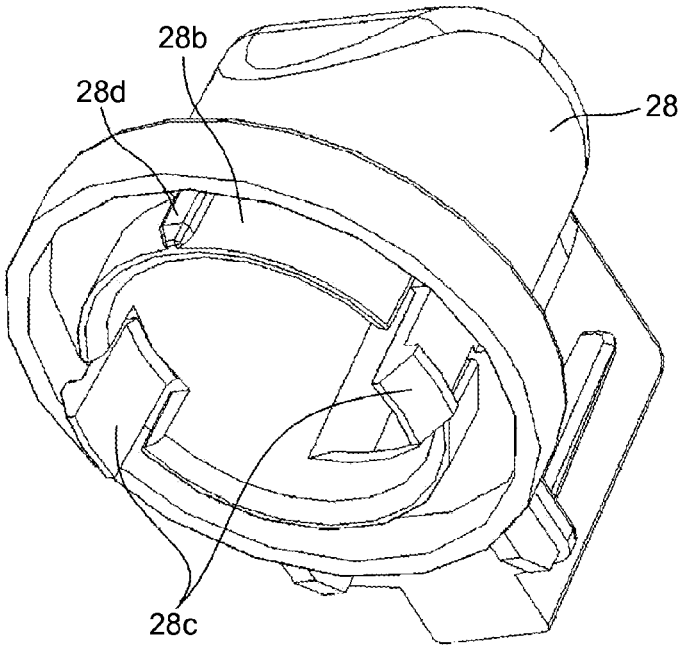
FIG. 7 illustrates an attachment structure of an air blow unit.
Figure 8:
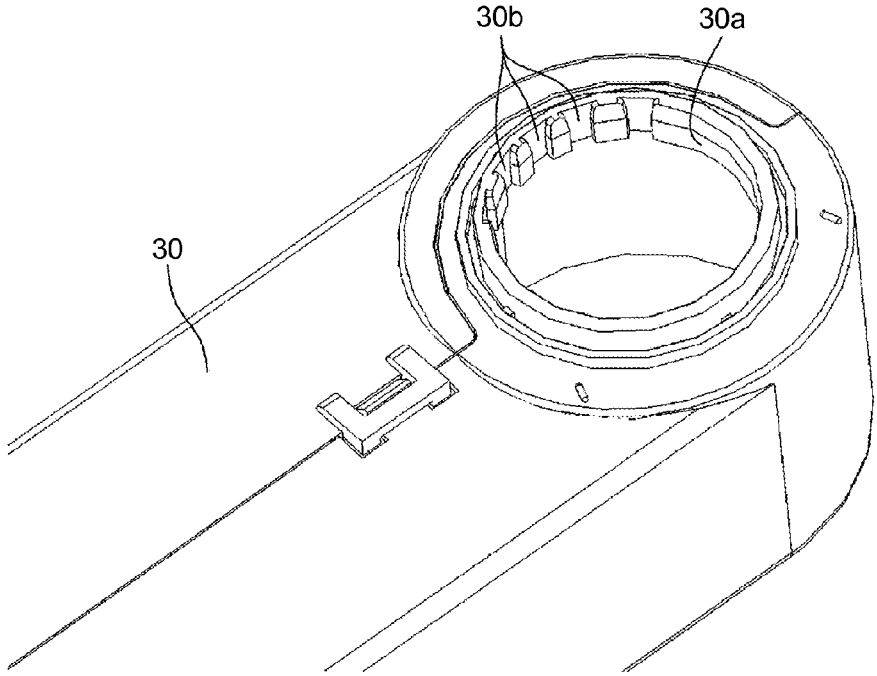
FIG. 8 illustrates an attachment structure of a duct to which the air blow unit is attached.

With reference to FIGS. 7 and 8, the attachment structures of the air blow unit 28 and the duct 30 will be described. Because each of the air blow units 28 is attached to the duct 30 in the same manner, a description will be given for how only one of the air blow units 28 is attached to the duct 30.

As depicted in FIG. 7, a cylindrical insertion part 28*b* is provided in the air blow unit 28. A pair of protruding claws 28*c* and a convex portion 28*d* are provided to the insertion part 28*b*. The claws 28*c* are elastically deformable in the radial direction of the cylindrical insertion part 28*b*.

A circular insertion hole 30*a* is formed on the upper surface of each end of the duct 30, and multiple concave portions 30*b* are arranged in the circumferential direction on the inner periphery of the insertion hole 30*a*. Alternatively, multiple convex portions may be arranged in the circumferential direction on the inner periphery of the insertion hole 30*a* and the intervals between the convex portions may be used as the concave portions 30*b*. Alternatively, the insertion hole 30*a* may be provided with convex portions while the insertion part 28*b* may be provided with concave portions.

When the air blow unit 28 is attached to the duct 30, the insertion part 28*b* of the air blow unit 28 is inserted into the insertion hole 30*a* of the duct 30. For the insertion, one of the concave portions 30*b* with which the insertion hole 30*a* is provided is selected and the convex portion 28*d* provided in the insertion part 28*b* engages with to the selected concave portion 30*b*. When the claws 28*c* are hooked on the periphery of the insertion hole 30*a* and thus the insertion part 28*b* is prevented from dropping from the insertion hole 30*a*, the air blow unit 28 is attached.

When the air blow units 28 is attached, engagement of the convex portion 28*d* with the concave portion 30*b* regulates circumferential rotation of the insertion part 28*b* in the circumferential direction with respect to the insertion hole 30*a*, which determines the orientation of the blow port 28*a* of the air blow unit 28. Accordingly, when the air blow unit 28 is attached, by selecting the concave portion 30*b* with which the convex portion 28*d* is to engage, the orientation of the blow port 28*a* can be set preferably. By detaching the air blow unit 28 and then engaging the air blow unit 28 again with another convex portion 30*b*, the orientation of the blow port 28*a* can be changed.

In the embodiment, the convex portion 28*d* and the concave portions 30*b* are cuboids such that the attached air blow unit 28 cannot rotate easily, which prevents the orientation of the blow port 28*a* from being changed even if the user unintentionally touches the air blow unit 28. In this case, the orientation of the blow port 28*a* can be changed only by a disassembling operation performed by a customer engineer. At least one of the edges of the convex portion 28*d* and the concave portions 30*b* may be formed to have a curved surface such that the convex portion 28*d* can pass over the concave portions relatively easily and thus the attached air blow unit 28 can be rotated.

Figure 9A:
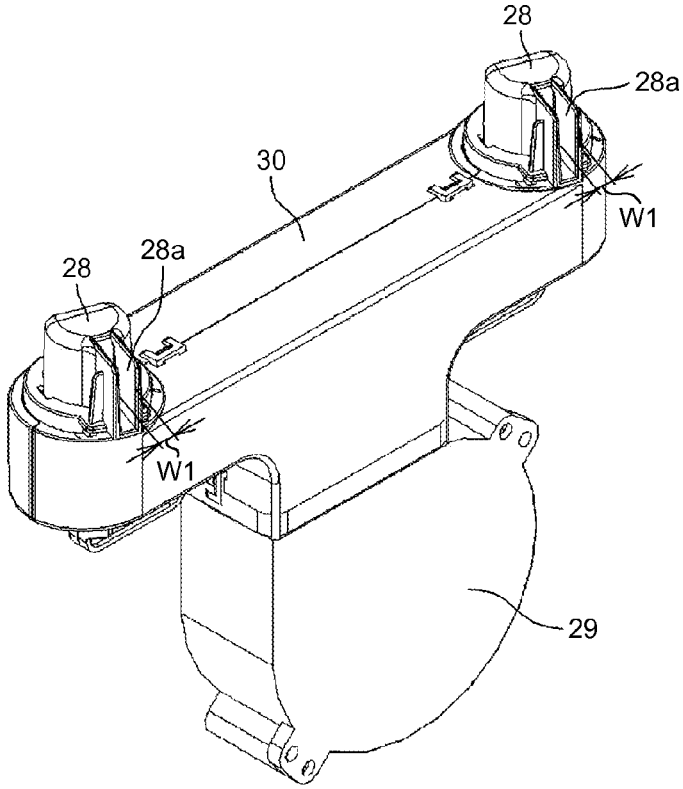
FIG. 9A illustrates sizes of an example of blow ports of air blow units.
Figure 9B:
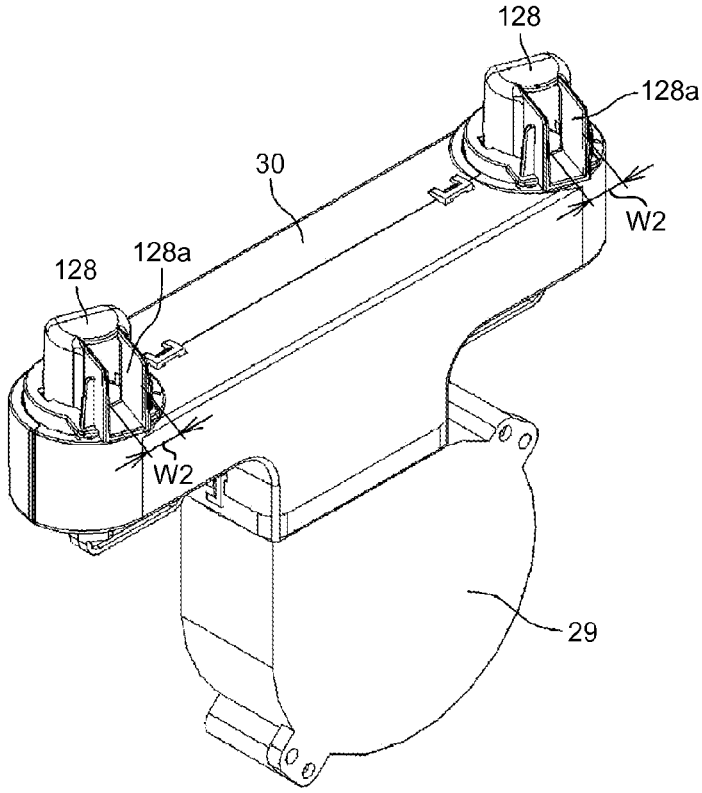
FIG. 9B illustrates sizes of another example of blow ports of replaceable air blow units.

As depicted in FIGS. 9A and 9B, the air blow units 28 that have the blow ports 28*a* of a width W1 may be replaced with another air blow units 128 that have the blow ports 128*a* of a width W2. In this case, the volume of the air that blows from the blow port can be adjusted without changing the output of the air supply unit 29. Accordingly, the volume of air can be increased to improve separation between paper sheets without increasing the power consumption of the air supply unit 29, which saves the power consumption of the devices. Furthermore, various types of paper sheets can be separated appropriately, which improves the feeding of paper sheets.

Figure 10:
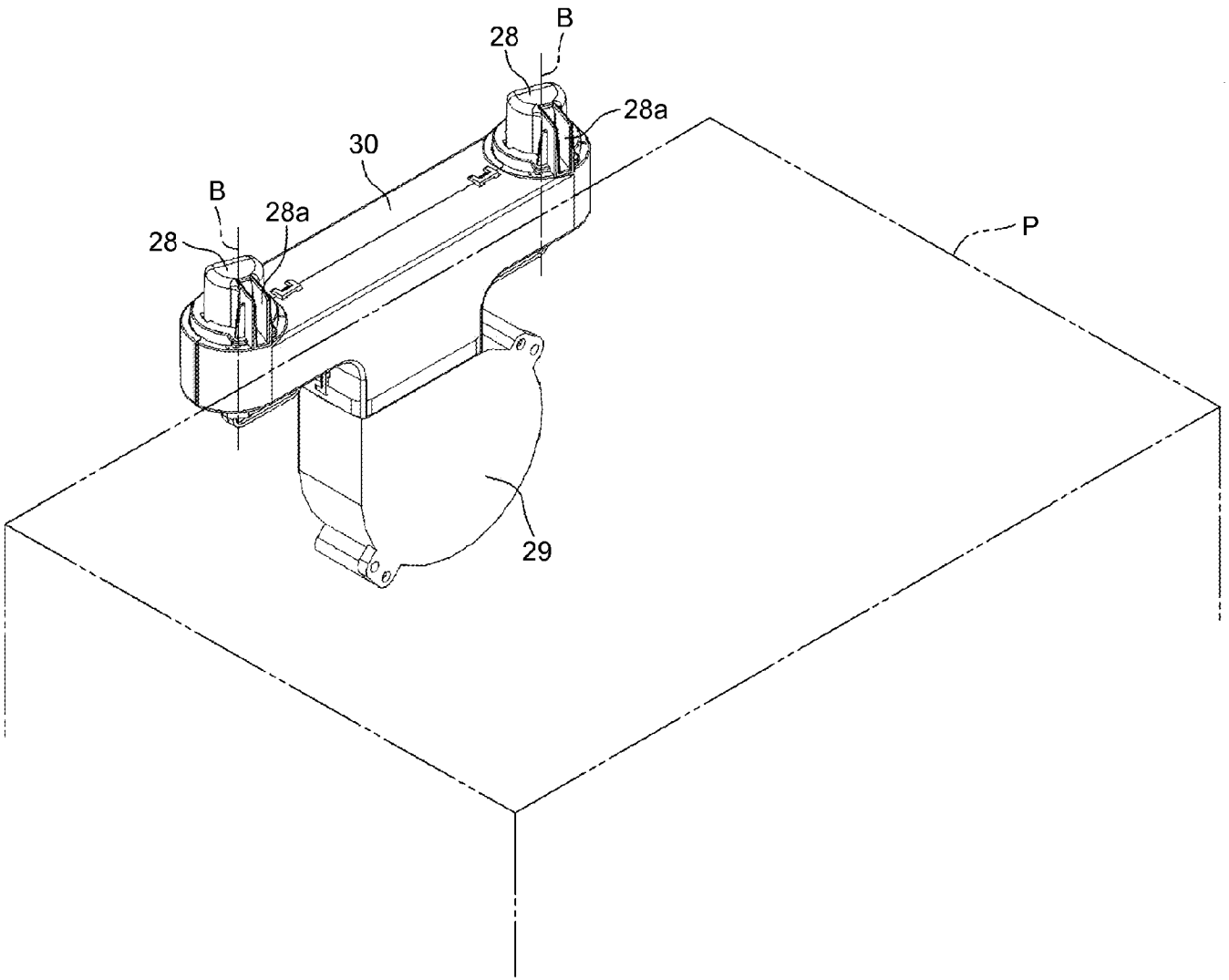
FIG. 10 illustrates the adjustable orientation of the air blow unit.
Figure 11:
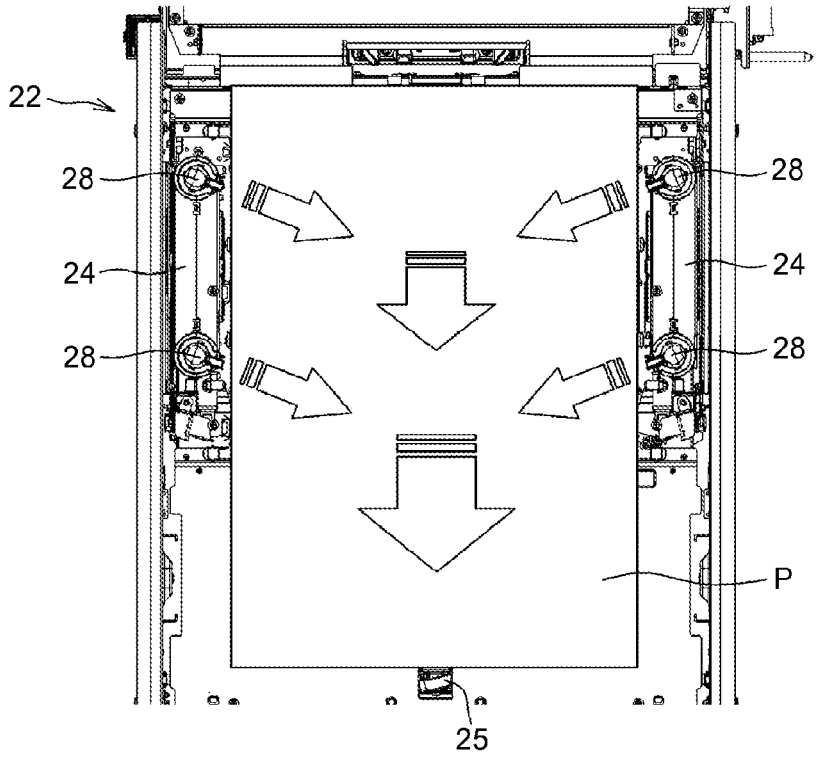
FIG. 11 is a diagram depicting a preferable direction in which the air is blown.
Figure 12:
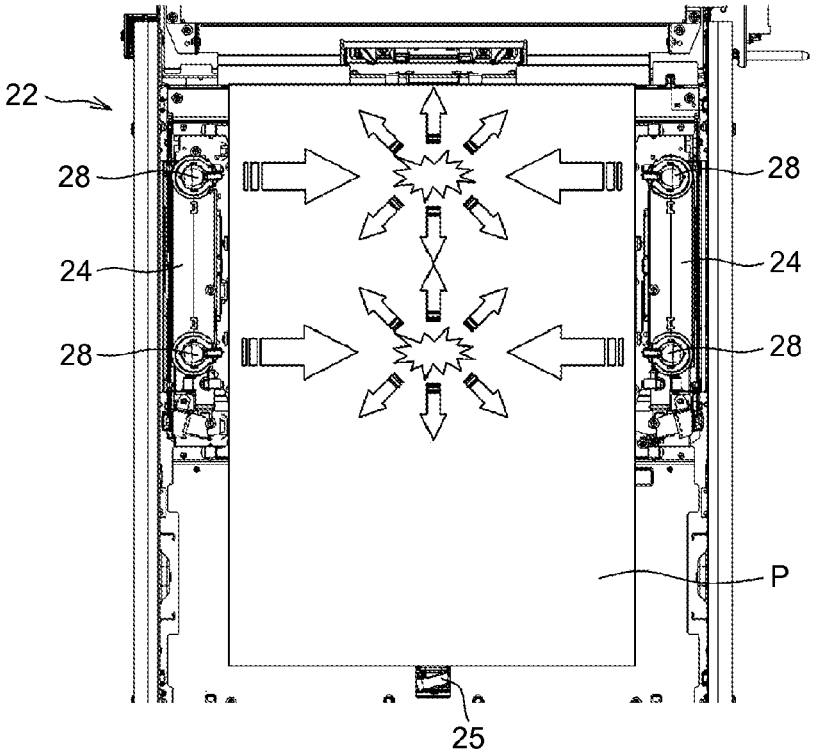
FIG. 12 is a diagram depicting a not-preferable direction in which the air is blown.

Because the paper feeding device according to the embodiment is configured as described above, the orientation of the blow port 28*a* of the air blow unit 28 can be changed about the axial line B perpendicular to (here, approximately orthogonal to) the plane corresponding to the surface of the stacked paper sheets P. In other words, because the concave portions 30*b* shown in FIG. 8 are arranged about the axial line B shown in FIG. 10, by changing the concave portion 30*b* into another one with which the convex portion 28*d* engages, the orientation of the blow port 28*a* can be changed about the axial line B. Accordingly, air can be blown in desired directions to the side ends of the stacked paper sheets P.

It is preferable that the directions in which air is blown against the paper sheets be not orthogonal to but oblique to the side ends of the paper sheets. By obliquely blowing air against the side ends of the paper sheets, the air can be smoothly sent between the paper sheets and accordingly the paper sheets can be separated more reliably.

On the other hand, if air is blown in directions orthogonal to the side ends of the paper sheets, the air blown from both sides collides and thus air disturbance and a loss in the air speed are caused and the paper sheets may not be separated sufficiently.

As described above, in the feeding device according to the embodiment, the blowing unit 27 is housed in the side fence 24. Accordingly, the blowing unit 27 can be moved with the side fence 24 in accordance with the paper-sheet size and the direction in which air is blown against the sheets can be changed. Accordingly, the position in which air is blown can be set appropriately in accordance with various paper sheets and thus efficient paper sheet separation can be performed.

The direction in which air is blown can be changed not by rotating the fan, which is performed in the conventional technology, but by changing only the orientation of the air blow unit 28. Accordingly, the apparatus can be compact and the configuration of the apparatus can be simplified.

Furthermore, in the embodiment, because the direction of the air flowing into the air blow unit 28 from the bottom can be changed horizontally and then the air is blown (see FIG. 6), the duct 30 and the air supply unit 29 can be arranged under the air blow unit 28. Accordingly, in the embodiment, the air blow units 28, the duct 30, and the air supply unit 29 can be arranged vertically, which prevents an increase in the horizontal size, and accordingly all of the air blow units 28, the duct 30, and the air supply unit 29 can be housed in the side fence 24.

By configuring the air supply unit 29 such that the air supply unit 29 can be attached in various positions to the duct 30 or such that the attached air supply unit 29 is rotatable, the air supply unit 29 and the duct 30 that are arranged in one of the side fences 24 and the air supply unit 29 and the duct 30 that are arranged in the other side fence 24 can have the same shapes. Accordingly, a common metal mold can be used to manufacture the air supply unit 29 and the duct 30, which reduces the manufacturing cost.

The embodiments of the present invention are described above. However, the present invention is not limited to the above-described embodiments. Various changes may be made without departing from the scope of the invention. The sheet feeding device according to the present invention may be applied to, in addition to the above-described electrophotographic color image forming apparatus, monochrome image forming apparatuses, ink-jet image forming apparatuses, copiers, printers, facsimile machines, and other multifunction peripherals that combine a copier, a printer, and/or a facsimile machine.

According to the embodiment, because the orientation of the blow port of the air blow unit can be changed about the axial line perpendicular to the plane corresponding to the surface of the stacked sheets, the direction in which air is blown can be set appropriately, which allows efficient sheet separation in accordance with various sheets. Furthermore, because the direction in which air is blown can be changed not by rotating the fan, which is performed in the conventional technology, but by changing only the orientation of the air blow unit 28, the apparatus can accordingly be compact and the configuration of the apparatus can be simplified.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feeding device comprising:

a stacking unit configured to allow multiple sheets to be stacked thereon;

a pair of side end regulating members configured to make contact with both side ends of the sheets stacked on the stacking unit so that positions of the side ends are regulated;

a feeding unit configured to feed one sheet at a time from the stacked sheets;

an air supply unit; and an air blow unit including a blow port from which air supplied from the air supply unit is blown against a side end of the stacked sheets, the air blow unit being housed in each of the side end regulating members, wherein each of the side end regulating members has an opening for exhausting the air that is blown from the blow port of the air blow unit to the stacked sheets, and an orientation of the blow port of the air blow unit is adjustable about an axial line perpendicular to a plane corresponding to a surface of the stacked sheets, wherein:

the side end regulating member includes a member forming an air flow channel for guiding the air supplied from the air supply unit to the air blow unit, the air blow unit is attachable to the member forming the air flow channel so that the orientation of the air blow port is changed about the axial line, and one of the air blow unit and the member forming the air flow channel has a plurality of concave portions that are arranged about the axial line, and the other one of the air blow unit and the member has a convex portion that selectively engages with one of the concave portions.

2. The sheet feeding device according to claim 1, wherein the air blow unit is replaceable with another air blow unit that includes a blow port having a size different.

3. The sheet feeding device according to claim 1, wherein the side end regulating unit includes a member forming an air flow channel for guiding the air supplied from the air supply unit to the air blow unit, and the air blow port is rotatable about the axial line with the air blow unit being attached to the member forming the air flow channel.

4. The sheet feeding device according to claim 3, wherein the air blow unit is replaceable with another air blow unit that includes a blow port having a size different.

5. The sheet feeding device according to claim 1, wherein a direction in which air flows is changed in the air blow unit so that the air is blown.

6. An image forming apparatus comprising the sheet feeding device according to claim 1.

7. The sheet feeding device according to claim 1, wherein the member is a duct that forms an air flow channel for guiding the air supplied from the air supply unit to the air blow unit.

8. The sheet feeding device according to claim 7, wherein air blow unit, the air supply unit, and the duct are all housed in the side end regulating member.

9. The sheet feeding device according to claim 7, wherein the duct is bifurcated as T-shaped.

10. The sheet feeding device according to claim 1, wherein the air blow unit includes a cylindrical insertion part.

11. The sheet feeding device according to claim 10, wherein the cylindrical insertion part includes a pair of protruding claws.

12. The sheet feeding device according to claim 11, wherein the claws are elastically deformable in the radial direction of the cylindrical insertion part.

13. The sheet feeding device according to claim 1, wherein the air blow unit includes a circular insertion hole.

14. The sheet feeding device according to claim 13, wherein the circular insertion hole is formed on an upper surface of the member forming the air flow channel.

15. The sheet feeding device according to claim 14, wherein the circular insertion hole includes the concave portion arranged in a circumferential direction on an inner periphery of the circular insertion hole.

* * * * *